United States Patent [19]

Fernandez

[11] Patent Number: 4,817,153

[45] Date of Patent: Mar. 28, 1989

[54] METHOD AND APPARATUS FOR TRANSFORMING A MONAURAL SIGNAL INTO STEREOPHONIC SIGNALS

[75] Inventor: Jorge D. Fernandez, Willowdale, Canada

[73] Assignee: Canamex Corporation, Willowdale, Canada

[21] Appl. No.: 167,996

[22] Filed: Mar. 14, 1988

[51] Int. Cl.[4] ..... H04R 5/00; H04R 25/00

[52] U.S. Cl. ..... 381/26; 381/92; 381/111; 381/168

[58] Field of Search ..... 381/1, 26, 92, 111–115, 381/122, 168–170, 175, 51, 187

[56] References Cited

U.S. PATENT DOCUMENTS 3,906,478 9/1975 Soney ..... 381/187

4,318,245 3/1982 Stowell et al. ..... 381/51

*Primary Examiner*—Jin F. Ng

*Assistant Examiner*—David H. Kim

*Attorney, Agent, or Firm*—Sim & McBurney

[57] ABSTRACT

An adapter converts a monaural microphone unit for stereophonic operation. The adapter has an elongate cylindrical housing including an input jack which rigidly attaches to the microphone and receives the microphone signal and an output jack which makes stereophonic signals available to recording equipment. Two distinct signal transmission channels are present in the adapter for transmission of the microphone signal to the output jack. A gravity-responsive switch selects which of the two transmission channels is active depending on the orientation of the adapter housing relative to vertical. An interviewer maintains the adapter and microphone in a vertical orientation or inclined towards him to record his questions along one channel and tilts the adapter unit towards his subject to record the response on the other signal channel. Resistors couple the two transmission channels to ensure that the non-active signal channel is not silent but at least carries the microphone signal in attenuated form. Delay circuits prevent sudden activation and deactivation of the transmission channels as by momentary tilting of the adapter microphone.

13 Claims, 3 Drawing Sheets

METHOD AND APPARATUS FOR TRANSFORMING A MONAURAL SIGNAL INTO STEREOPHONIC SIGNALS

FIELD OF THE INVENTION

The invention relates generally to stereophonic sound recording, and more specifically, to methods and apparatus for transforming a monaural signal produced by a microphone unit into stereophonic signals.

BACKGROUND OF THE INVENTION

The invention is particularly useful in connection with the interviewing of individuals for news broadcasts, but can be used in any situation in which stereophonic recording of sounds is desired.

Interviews which are performed on location for news broadcasts normally involve a single interviewer accompanied by a single cameraman. During monaural recording, the interviewer normally holds a microphone immediately in front of himself to record his question, and then advances the microphone to a subject in order to record a response. The question and response are sequentially transmitted along a single transmission channel and recorded essentially as a single monaural recording.

Since broadcast stations have in recent years expended considerable money to provide stereophonic transmission of sound in connection with video broadcasts, it would be desirable to permit newscast interviews to be recorded stereophonically. At present, this would involve providing the subject with a separate microphone, which is inconvenient, or alternatively providing the interviewer with a comparatively expensive stereophonic microphone. Stereophonic microphones commonly comprise separate transducers coupled to separate signal transmission channels, an electronic representation of sound being transitted on different transmission channels depending on the direction from which the sound is received. Such microphones are fairly expensive and sometimes difficult to orient for proper division of signals between transmission channels.

SUMMARY OF THE INVENTION

In one aspect, the invention provides apparatus for transforming sound into stereophonic electronic signals. The apparatus includes a transducer unit for transforming sound into a corresponding electronic signal. A pair of signal transmission channel receive and transmist the electronic signal produced by the transducer unit. Means are provided for controlling transmission of the electronic signal in the signal transmission channels, including gravity-responsive switching means which activate a first one of the signal transmission channel and deactivate the second signal transmission channel whenever the apparatus assumes a first orientation and which activate the second signal transmission channel and deactivate the first signal transmission channel whenever the apparatus assumes a second orientation.

In another aspect, the invention provides an adapter which converts a monaural microphone unit for stereophonic operation. The adapter comprises a housing having connection means for use in rigidly and releasably joining the housing to the microphone unit, a signal input port for receiving the electronic signal, and a signal output port. The electronic signal can be transmitted from the signal input port to the signal output port along first and second transmission channels. Means are provided for controlling transmission of the electronic signal including switching means responsive to gravity for activating the first signal transmission channel and deactivating the second signal transmission channel whenever the housing assumes a first orientation relative to vertical and for activating the second signal transmission channel and deactivating the first signal transmission channel whenever the housing assumes a second orientation relative to vertical.

For purposes of the invention, a signal transmission channel is "deactivated" if transmission in the deactivated channel is attenuated relative to transmission in the "active" channel. It will be appreciated by those skilled in the art that complete blocking of a signal common to two transmission channels, for example, in the left and right channel of a stereophonic sound reproduction system, is not essential for production of a stereophonic effect. This is also true of the present invention, and in fact, in a preferred embodiment described below, steps are taken to ensure that there is always some measure of signal transmission in the currently deactivated transmission channel to avoid unnatural silence in the signal channel during stereophonic reproduction or playback following recording.

Other aspects and advantages of the present invention will be apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENT

Figure 1:
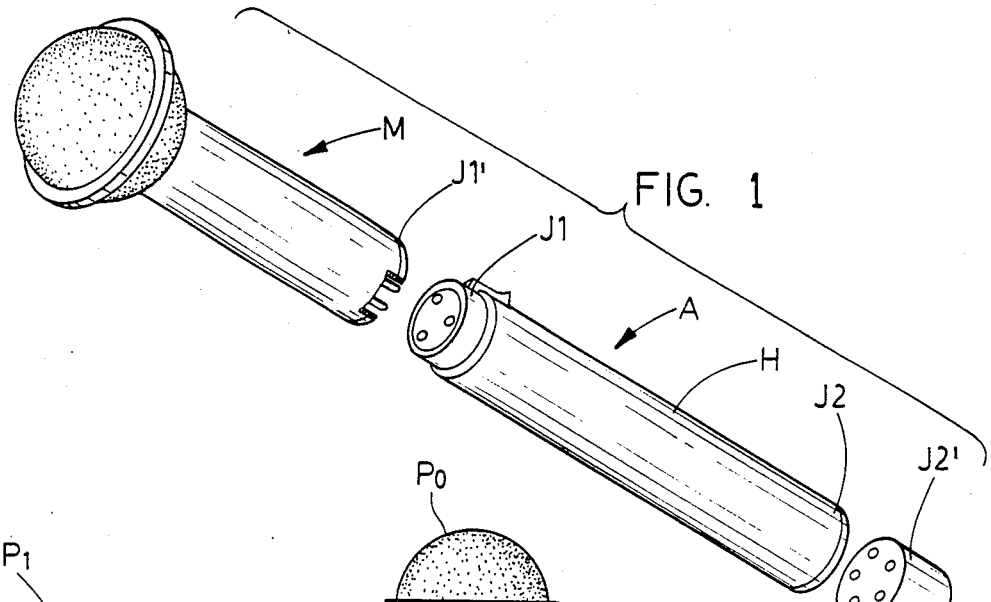
FIG. 1 is a perspective view of a monaural microphone unit and adapter for converting the microphone unit for stereophonic operation.

Reference is made to FIG. 1 which illustrates a monaural microphone unti M mounted on a stereophonic adapter A. The microphone unit M is a conventional transducer which converts sound into a corresponding electronic signal. The adapter A has a cylindrical housing H which is dimensioned to be hand-held by the user to support the microphone unit M. The adapter housing H has a female bayonet-type jack or connector J1 for releasably joining with a complementary male connector J1' (the cylindrical sidewall of which is shown partially fragment to reveal contact pins) associated with the microphone unit M. The junction is sufficiently rigid that the central longitudinal axes of the microphone unit M and adapter A remain aligned during use. Appropriate connectors are commonly known as "XLR" connectors and are normally available with professional quality microphones. A conventional male output jack or connector J2 is attached to an opposing end of the adapter housing H and receives a complementary male connector J2'. The connector J2' is associated with appropriate wiring which may lead to a recording unit (not illustrated).

Figure 3:
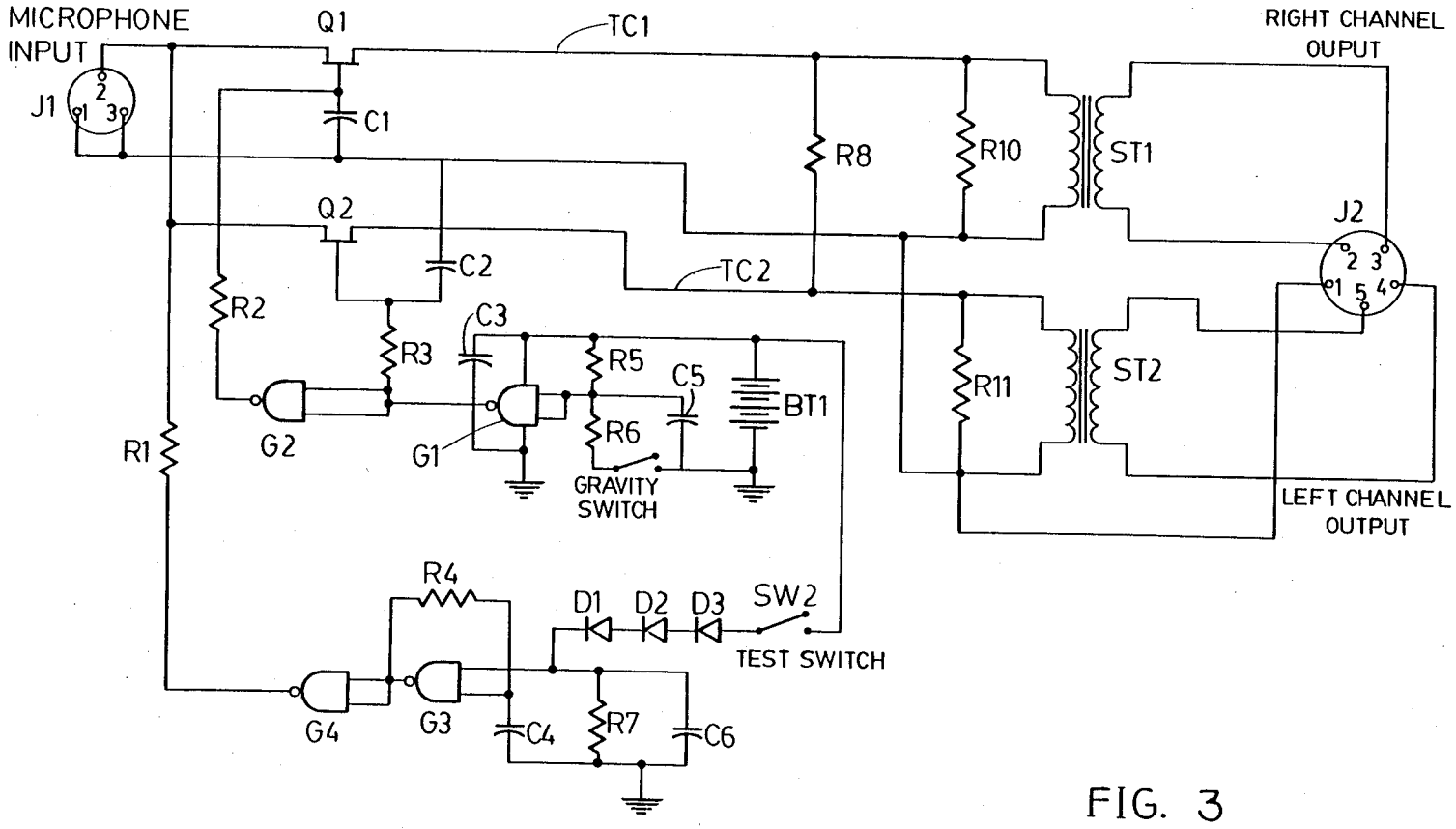
FIG. 3 is a schematic representation of the electronic circuitry associated with the adapter; and, FIG. 4 graphically illustrates how the adapter gradually switches transmission of signal produced by the microphone unit between transmission channels associated with the adapter; and, FIG. 5 illustrates signal levels in the transmission channels of the adapter before, during and after channel switching.

The circuitry mounted in the interior of the adapter A is illustrated in FIG. 3. The jack J1 is a three-terminal connector which essentially defines a signal input port for receiving the electronic signal produced by the microphone unit M. The jack J1 includes a terminal designated 1 which receives the microphone signal and terminals 2, 3 which serve as reference lines. The output jack J2' serves as a signal output port where the microphone signal appears divided into "left" and "right" signal channels. Pins 2 and 3 associated with the jack J2 make available the right channel signal; pins 4 and 5, the left channel signal. Pin 1 associated with the jack J2 serves as a common signal reference.

The circuitry defines two signal tranmission channels YC1 and TC2 between the input connector J1 and the output connector J2. Signals transmitted in these channels are applied to the output connector J2 through transformers ST1 and ST2 to provide a measure of isolation between the adapter A and any associated recording equipment. The transformers in this instance have a 1:1 winding ratio, and it will be apparent to those skilled in the art that the output impedance presented at the connector J2 will be in the order of about 100–300 ohms, namely, in the range of the output impedance expected of a typical microphone unit M. Two metal oxide semiconductor field effect transitors Q1, Q2 control application of the microphone signal to the transmission channels TC1, TC2. The conduction state of each of these transistors is ultimately controlled by a gravity-responsive switch SW1, a conventional mercury switch.

The circuitry is operated from a 6 volt DC battery BT1 and a smoothing capacitor C3 (0.1 $\mu$F) mounted in the interior of the adapter housing H. The battery voltage is applied through a resistive divider consisting of resistors R5 (1M) and R6 (150K) to the input stage of an inverter (constituted by connecting the input terminals of a NAND gate G1) and is smoothed by a capacitor C5 (0.1 $\mu$F). The resulting output signal of the inverter is applied to the gate of the transistor Q2 through a delay circuit comprising resistor R3 (1M) and capacitor C2 (0.1 $\mu$F) and is also applied to the input of another inverter (a similarly configured NAND gate G2). The output of the second inverter is applied through a delay circuit comprising resistor R2 (1M) and capacitor C1 (0.1 $\mu$F) to the gate of the transistor Q1. Accordingly, with the gravity switch SW1 open, the battery voltage is effectively applied through the associated delay circuit to the gate of transistor Q1 which is then set to assume a conductive state and a zero voltage is simultaneously applied through the associated delay circuit to the gate of transistor Q2 which is then set to assume a non-conductive state. This activates the transmission channel TC1 and deactivates the transmission channel TC2. Conversely, with the gravity switch SW1 closed, the transmission channel TC1 is deactivated and the transmission channel TC2 becomes the active transmission channel.

Figure 2:
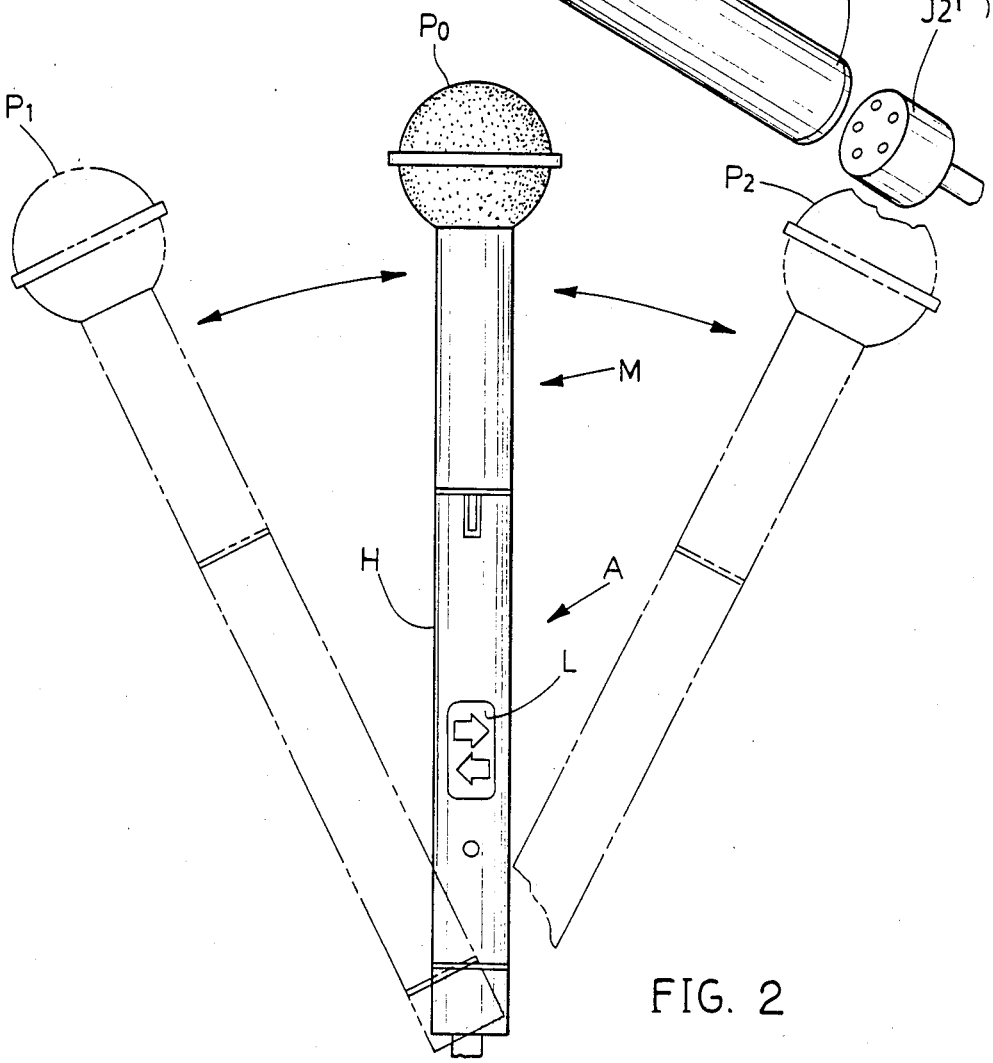
FIG. 2 is a perspective view showing alternative orientations of the combined unit of FIG. 1 which cause switching of the microphone signal between different transmission channels.

The gravity switch SW1 changes between its open and closed states nominally at the vertical orientation designated $P_0$ and illustrated in solid lines in FIG. 2. Switching of transmission channels occurs when the microphone unit M and adapter housing H are inclined in opposite directions relative to a vertical plane (in FIG. 2 a plane perpendicular to the plane of the drawing page.) When the adapter A is inclined in a first direction relative to the particular vertical plane (through what is arbitrarily considered a positive angle), as for example to the orientation shown in phantom outline in FIG. 2 and designated $P_1$, the gravity switch SW1 closes thereby activating the right transmission channel TC2. When the adapter A is inclined in an opposite direction relative to the particular vertical plane (through a negative single), as for example to the orientation shown in phantom outline in FIG. 2 and designated $P_2$, the gravity switch SW1 opens thereby activating the left transmission channel TC1. The manner in which the mercury switch SW1 is physically mounted in the adapter housing H to achieve switching between open and closed states as the axis of the adapter housing H tilts relative to a vertical plane will be readily apparent to persons skilled in the art. It should be noted that the vertical position $P_0$ corresponds to an indeterminate state of the switch SW1, where transition between closed and open states will not necessarily occur owing to physical limitations inherent in a mercury switch.

In practice, switching may be arranged to occur in a positive fashion as the adapter housing H is inclined beyond an angular range extending from about +5 degrees to about −5 degrees relative to vertical. A label L on the exterior of the adapter housing bears arrows which indicate to a user the particular vertical plane relative to which the adapter housing should be tilted to achieve proper switching. An alternative view of this arrangement is that the label L indicates the vertical plane in which the microphone unit M and adapter housing H should be tilted to achieve proper switching between transmission channels. In FIG. 2, this is the plane of the drawing sheet. The label L or other indicia are significant in this particular arrangement to facilitate proper orientation of the microphone unit M and adapter housing H.

The manner in which an interviewer might operate the device during an interview to produce a stereophonic signal will be described with reference to FIG. 2. The label L might typically be oriented to face a camera (not illustrated) recording interviewer and subject with the subject to the left of position $P_1$ and the interviewer to the right of position $P_2$. The interviewer would tilt the microphone unit M and adapter A towards himself, as to the orientation $P_2$, to record his questions. In such circumstances, the transmission channel TC1 would be active, and the interviewer's voice would be electronically transmitted primarily in the right signal channel. To record the subject's response, the interviewer would incline the microphone unit M and adapter A towards the subject, substantially in the orientation $P_1$. The transmission channel TC2 is then made the active channel, and the subject's response is transmitted primarily in the left signal channel. What is particularly advantageous about this aspect of the invention is that the motion and orientation of the microphone unit M and adapter A required to switch transmission of microphone signals between the two signal transmission channels corresponds precisely to the type of movement of the microphone unit M which would otherwise occur during an interview session using a conventional monaural microphone. The natural arm movement of the interviewer and gravity are used to trigger the mercury switch SW1 to produce stereophonic rather than monaural signals.

Other arrangements within the ambit of the present invention mayuse a zero degree inclination relative to vertical as one of the orientations in which a particular transmission channel becomes active. For example, a gravity responsive switch might be mounted in the adapter housing such that the vertical position $P_0$ results in the interviewer's voice being recorded on the transmission channel TC1 and such that any inclination of the microphone unit M and adapter A beyond a predetermined angle relative to vertical in any direction causes the other transmission channel TC2 to then become active. This once again permits switching of transmission channels in response to the arm movement which is inherent to such an interviewing process.

Figure 4:
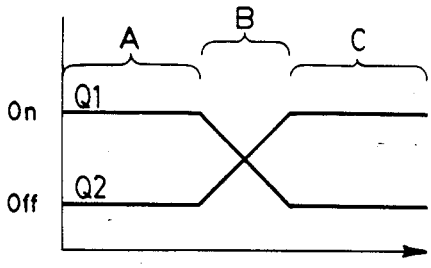

According to another aspect of the invention, the activation and deactivation of the transmission channels is preferably delayed to provide a gradual transition between active and non-active states. Such delays are provided by the circuits mentioned above comprising the combination of resistor R2 and capacitor C1 and the combination of resistor R3 and capacitor C2. The effect of these delays is graphically illustrated in FIG. 4 where the conductive states of the transistors Q1, Q2 before, during, and after a change in the orientation of the gravity switch SW1 relative to vertical are indicated. The transistors Q1, Q2 may be seen respectively to be fully conductive and non-conductive during the time interval A prior to switching, and respectively non-conductive and conductive during the time interval C immediately following switching. Such switching might occur, for example, when the adapter housing H is tilted from the substantially vertical orientation shown in solid lines in FIG. 2 to the inclined orientation shown in phantom outline in fig. 2. Intermediate the conductive and non-conductive states of both transistor switches Q1, Q2, as indicated during the time interval B, there are semiconductive states in which neither transistor Q1 or Q2 is fully turned on or off. During this time interval B, the transistor Q1 gradually shuts off and the transistor Q2 gradually turns on so that the microphone signal is gradually attenuated in the active transmission channel TC1 and gradually increased in the deactivated transmission channel TC2. This arrangement prevents switching in response to momentary changes in the orientation of the adapter housing H, which might occur as the interviewer attempts to follow a quick question and answer session, and also avoids the creation of noise spike in the transmission channels TC1, TC2.

Figure 5:
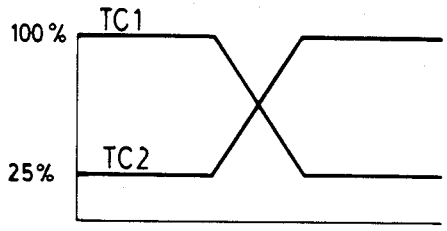

According to another aspect of the invention, total absence of transmission of the microphone signal in either channel TC1, TC2 is preferably avoided. In the final broadcast or replayed version of the sound recording, it may be undesirable in the stereophonic reproduction to leave one channel totally silent. To that end, a resistor R8 (2.7K) couples the two signal transmission channels TC1, TC2 downstream of the two transmission switches Q1, Q2. The resistors R8 together with a resistor R10 (2.2K) and the impedance presented by the primary winding of the transformer ST1 or alternatively together with the resistor R11 (2.2K) and the impedance presented by the primary winding of the transformer ST2 constitute voltage dividers. Thus, for example, when the transmission channel TC1 is active, a signal corresponding to the electronic microphone signal scaled by a factor of about 25% is applied from the active channel TC1 to the non-active transmission channel TC2. This arrangement is graphically illustrated in FIG. 5 which show signal levels in the transmission channels TC1, TC2 corresponding to the switching occurring in FIG. 4. While the transmission channel TC1 is active, the microphone signal is transmitted at one-quarter strength in the transmission channel TC2; signal strength in the transmission channel TC1 declines and rises in the transmission channel TC2 rises, during the intermediate switching stage when neither transistor Q1, Q2 is fully active or fully turned off; and transmitted signal levels are finally fully reversed. A variable resistor may be used to couple the transmission channels to permit adjustment of the balance between the signals in the two transmission channels TC1, TC2.

According to another aspect of the invention, a novel arrangement is provided for testing the adapter battery BT1 when a test switch SW2 is operated. The test switch SW2 is concealed within the adapter housing A, but can be depressed to set the switch from its normal open state to a momentary closed state by inserting a paper clip or a small screw driver through an opening (illustrated in FIG. 2, but not specifically indicated) formed in the adapter housing A.

The battery voltage is level-shifted downwardly by about 1.8 volts (three diode voltage drops) by a divider comprising three diodes D1, D2, D3 and resistor R7 (5.6K). The level-shifted voltage produced at the junction of the resistor R7 and diode D1 is smoothed by a capacitor C6 to eliminate transient effects and applied to one input terminal of an oscillator circuit based on a NAND gate G3. The other input terminal of the gate G3 is coupled to a ground reference by a capacitor C4 (3.3 nF) and to the output terminal of the gate G3 by a feedback resistor R4 (510K). The output signal generated by the gate G3 is inverted by another NAND gate G4 (whose input terminals are connected to constitute an inverter). The output signal of the inverter is then applied through a resistor R1 (2.2M) to both transmission channels TC1, TC2 immediately upstream of the transistor switches Q1, Q2.

When the battery test switch SW2 is open, one input terminal of the gate G3 is at ground and the output terminal of the gate G3 is locked at the battery supply voltage. This logic-high output voltage is inverted by the gate G4 to the ground reference level so that no signal is applied to either transmission channel TC1, TC2.

When the test switch SW2 is depressed, two possible cases occur. In the first, the level shifted voltage may be above 3.0 volts which is recognized as a logic-high value at the input terminal of the gate G3. The gate G3 then begins to oscillate at a frequency set in a conventional manner by the resistor R4 and capacitor C4 to be within the expected frequency range of the microphone signal.Accordingly, recording equipment can audibly reproduce this signal and provide an indication, an audible tone at the frequency of oscillation, indicating that the battery BT1 still has a measure of useful life. This life expectancy might typically be arranged to be one hour. In the present case, it has been assumed that the battery voltage, when fully charged, will decline by less than 1.2 volts (6 volts minus 1.8 volts minus 3.0 volts) during continuous operation.

In the second case, the battery voltage has declined such that the level-shifted voltage is below 3.0 volts, and is recognized as a logic zero value at the relevant input terminal of the NAND gate G3. In such circumstances, oscillation of the gate G3 is suppressed, and no oscillatory signal is applied to either of the transmission channels TC1, TC2. Accordingly, any recording equipment coupled to the adapter A will not produce an audible signal indicating that the battery BT1 has a predictable life expectancy. The battery BT1 in such circumstance will not necessarily be disharged sufficiently to prevent operation, but the operator has an indication that the battery BT1 must be replaced in due course. Such an arrangement is preferable to the more customary practice of simply indicating once a battery fails that is need replacing.

It will be appreciated that a particular embodiment of the invention has been described and that modifications may be made therein without departing from the spirit of the invention or necessarily departing from the scope of the appended claims. The invention is not necessarily limited to applications in which a microphone unit is to be manipulated by hand. For example, it would be possible to mount a monaural microphone unit and the adapter of the present invention on a boom, and to arrange for manual or motorized tilting of the boom to produce the changes in orientation of the apparatus required to divide the monaural signal between transmission channels.

I claim:

1. Apparatus for transforming sound into stereophonic electronic signals, comprising:

a transducer unit for transforming the sound into a corresponding electronic signal;

means defining a first signal transmission channel for receiving and transmitting the electronic signal produced by the transducer unit and a second signal transmission channel for receiving and transmitting the electronic signal produced by the transducer unit;

means for controlling transmission of the electronic signal by the first and second signal transmission channels, the transmission control means including switching means responsive to gravity for activating the first signal transmission channel for transmission of the electronic signal and deactivating the second signal transmission channel whenever the apparatus assumes a first orientation relative to vertical and for activating the second signal transmission channel for transmission of the electronic signal and deactivating the first signal transmission channel whenever the apparatus assumes a second orientation relative to vertical.

2. Apparatus as claimed in claim 1 in which the transmission control means comprise:

first signal switching means for coupling the electronic signal from the transducer to the first transmission channel;

second signal switching means for coupling the electronic signal from the transducer to the second transmission channel;

each of the first and second signal switching means having a plurality of conduction states including a conductive state in which the electronic signal is applied to the associated signal transmission channel and a non-conductive state in which the electronic signal is not applied to the associated signal transmission channel;

the gravity-responsive switching means setting the conduction states of the first and second signal switching means, the gravity-responsive switching means setting one of the first and second signal switching means to a non-conductive state whenever the gravity-responsive means set the other of the first and second switching means to a conductive state.

3. Apparatus as claimed in claim 2 in which the transmission control means comprise means for coupling the first and second signal transmission channels such that transmission of the electronic signal in the active transmission channel causes an attenuated signal corresponding to the electronic signal to be applied to the deactivated transmission channel and to be transmitted by the deactivated transmission channel.

4. Apparatus as claimed in claim 3 in which the transmission channel coupling means comprise a resistor connected between the first and second signal transmission channels.

5. Apparatus as claimed in claim 1 comprising means coupling the first and second transmission channels such that transmission of the electronic signal in the active transmission channel causes an attenuated signal corresponding to the electronic signal to be applied to the deactivated transmission channel and to be transmitted by the deactivated transmission channel.

6. Apparatus as claimed in claim 1 in which:

the first orientation corresponds to an inclination of the apparatus through at least a first predetermined angle in a first direction relative to a vertical plane;

the second orientation corresponds to an inclination of the apparatus through at least a second predetermined angle in a second direction opposite to the first direction relative to the vertical plane; and, the apparatus comprises indicia on the exterior thereof visually indicating the first and second directions relative to the vertical plane.

7. A device for transforming a monaural electronic signal produced by a microphone unit into sterophonic electronic signals, comprising:

a housing having connection means for use in rigidly and releasably joining the housing to the microphone unit, a signal input port associated with the connection means for receiving the electronic signal, and a signal output port;

means for defining within the housing a first signal transmission channel for transmission of the electronic signal from the signal input port to the signal output port and a second signal transmission channel for transmission of the electronic signal from the signal input port to the signal output port; and, means for controlling transmission of the electronic signal by the first and second signal transmission channels, the transmission control means including switching means responsive to gravity for activating the first signal transmission channel for transmission of the electronic signal and deactivating the second signal transmission channel whenever the housing assumes a first orientation relative to vertical and for activating the second signal transmission channel for transmission of the electronic signal and deactivating the first signal transmission channel whenever the housing assumes a second orientation relative to vertical.

8. A device as claimed in claim 7 in which the transmission control means comprise:

first signal switching means for coupling the electronic signal from the microphone unit to the first transmission channel;

second signal switching means for coupling the electronic signal from the microphone unit to the second transmission channel;

each of the signal switching means having a plurality of conduction states including a conductive state in which the electronic signal is applied to the associated signal transmission channel and a non-conductive state in which the electronic signal is not applied to the associated signal transmission channel;

the gravity-responsive switching means setting the conduction states of the first and second signal switching means, the gravity-responsive switching means setting one of the first and second switching means to a non-conductive state whenever the gravity-responsive means set the other of the first and second switching means to a conductive state.

9. A device as claimed in claim 8 in which the transmission control means comprise means for coupling the first and second transmission channels such that transmission of the electronic signal in the active transmission channel causes an attenuated signal corresponding to the electronic signal to be applied to the deactivated transmission channel.

10. A device as claimed in claim 9 in which the transmission channel coupling means comprise a resistor connected between the first and second transmission channels.

11. A device as claimed in claim 7 comprising means coupling the first and second transmission channels such that transmission of the electronic signal in the active transmission channel causes an attenuated signal corresponding to the electronic signal to be applied to the deactivated transmission channel and to be transmitted by the deactivated transmission channel to the signal output port.

12. A device as claimed in claim 7 in which the gravity-responsive switching means comprise a mercury switch.

13. A device as claimed in claim 7 in which:

the first orientation corresponds to an inclination of the device through at least a first predetermined angle in a first direction relative to a vertical plane;

the second orientation corresponds to an inclination of the device through at least a second predetermined angle in a second direction opposite to the first direction relative to the vertical plane; and, the device comprises indicia on the exterior of the housing visually indicating the first and second directions relative to the vertical plane.

* * * * *